US008747156B2

(12) United States Patent
Hirabayashi

(10) Patent No.: US 8,747,156 B2
(45) Date of Patent: Jun. 10, 2014

(54) TERMINAL FITTING

(75) Inventor: Osamu Hirabayashi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 114 days.

(21) Appl. No.: 13/471,779

(22) Filed: May 15, 2012

(65) Prior Publication Data

US 2012/0295493 A1 Nov. 22, 2012

(30) Foreign Application Priority Data

May 19, 2011 (JP) ..... 2011-111970

(51) Int. Cl.
*H01R 13/40* (2006.01)

(52) U.S. Cl.
USPC ..... 439/595

(58) Field of Classification Search
USPC ..... 439/595, 852
See application file for complete search history.

(56) References Cited

U.S. PATENT DOCUMENTS 5,836,793 A * 11/1998 Chaillot et al. ..... 439/852
7,374,465 B2 * 5/2008 Tanaka ..... 439/852

FOREIGN PATENT DOCUMENTS

JP 2010-49841 3/2010

* cited by examiner

*Primary Examiner* — Phuong Dinh
(74) *Attorney, Agent, or Firm* — Gerald E. Hespos; Michael J. Porco; Matthew T. Hespos

(57) ABSTRACT

A terminal fitting (10) includes a tubular main portion (11) into which a mating male tab (91) is insertable. A resiliently deformable contact piece (22) which is to be resiliently held in contact with the male tab 91 is formed in the main portion (11), and a contact portion (32) which receives the male tab (91) is formed fixedly at a position facing the resilient contact piece (22). A ceiling wall (19) is at a position opposite to the resilient contact piece outward of the contact portion (32). A ceiling wall lance hole (27) penetrates through the ceiling wall (19) and can receive a locking lance (64) for retaining the terminal fitting (10) in a connector (60). A clearance (33) is formed between the ceiling wall (19) and the contact portion (32) for allowing the entry of the locking lance (54).

10 Claims, 11 Drawing Sheets

TERMINAL FITTING

BACKGROUND OF THE INVENTION

1. Field of the Invention

The invention relates to a terminal fitting.

2. Description of the Related Art

Japanese Unexamined Patent Publication No. 2010-49841 discloses a terminal fitting with a tubular main portion that has an open front end. A resilient contact piece and a fixed contact portion face one another in the main portion. A male tab can be inserted into the main portion from the front and is contacted resiliently between the resilient contact piece and the fixed contact portion. The terminal fitting is connected to a wire and is inserted from behind into a cavity of a housing. A resiliently deformable locking lance is formed at an inner wall of the cavity and a tip part of the locking lance engages a rear edge of the main portion from behind when the terminal fitting is inserted properly into the cavity of the housing. Thus, the locking lance retains the terminal fitting in the cavity.

A longer locking lance will resiliently deform more smoothly. If the entire length of the locking lance is made longer, a tip part of the locking lance will reach a central part of an outer wall of the main portion. Therefore a lance hole has to be formed in this central part of the outer wall for receiving the tip part of the locking lance. However, the contact portion is formed at an inner side of the outer wall and almost no clearance is formed between the outer wall and the contact portion. Thus, the locking lance may not be inserted deeply into the lance hole and may come out of the lance hole.

The invention is based on the above situation and an object thereof is to provide a terminal fitting that ensures a sufficient engagement margin with a locking lance.

SUMMARY OF THE INVENTION

The invention is directed to a terminal fitting with a tubular main portion into which a mating male tab is insertable. A resiliently deformable contact piece is formed in the main portion and can be held resiliently in contact with the male tab. A fixed contact portion is formed in the main portion at a position facing the resilient contact piece and can engage the male tab. An outer wall is provided on side of the main portion opposite the resilient contact piece and outward of the fixed contact portion. A lance hole penetrates the outer wall and can receive a locking lance for retaining the terminal fitting in a connector. A clearance is formed between the outer wall and the contact portion for allowing the entry the locking lance. Thus, the locking lance can escape into the clearance and can be inserted deeply into the lance hole. As a result, an appropriate engagement margin of the locking lance with the main portion is ensured A recess preferably is formed in a surface of the contact portion facing the outer wall and the tip of the locking lance can escape into the recess. Thus, the locking lance can be inserted more deeply into the lance hole. As a result, the locking lance is less likely to come out of the lance hole The recess preferably is formed within the thickness range of the contact portion. Thus, the contact portion will not project farther into the insertion space for the male tab and an insertion space for the male tab can be ensured.

A projection may be formed at a position back to back with the recess on a surface of the contact portion facing the resilient contact piece. Thus, the depth of the recess can be increased and a large engagement margin with the male tab is ensured The male tab preferably is insertable into a substantially central part of the main portion. A second lance hole also may penetrate through a second outer wall of the main portion. Thus, the terminal fitting can be inserted in an inverted posture into the connector by selectively using either lance hole. As a result, the versatility of the terminal fitting is improved.

DETAILED DESCRIPTION OF THE PREFERRED EMBODIMENTS

Figure 10:
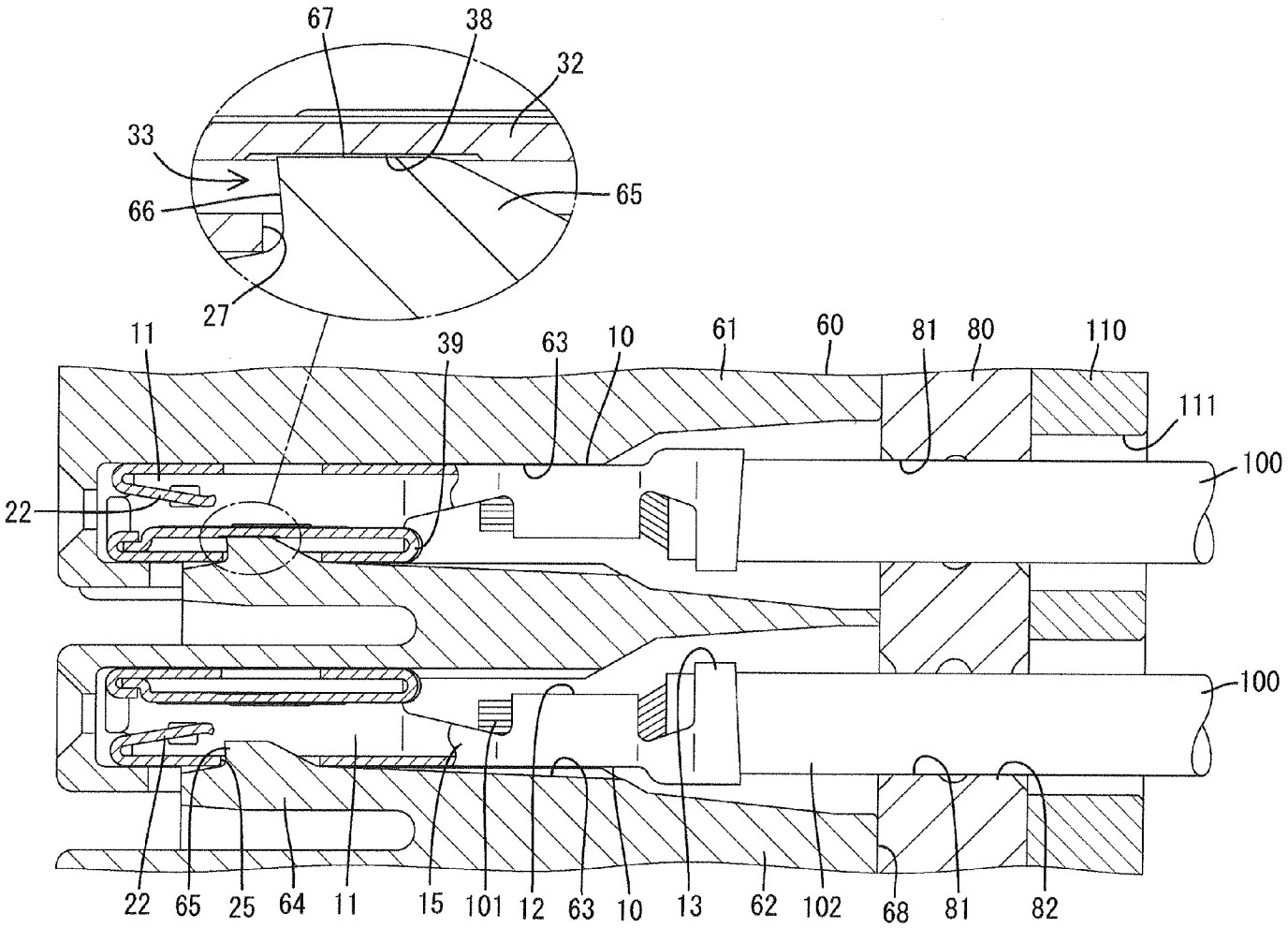
FIG. 10 is a section showing a state where terminal fittings are properly inserted in cavities of a housing.
Figure 11:
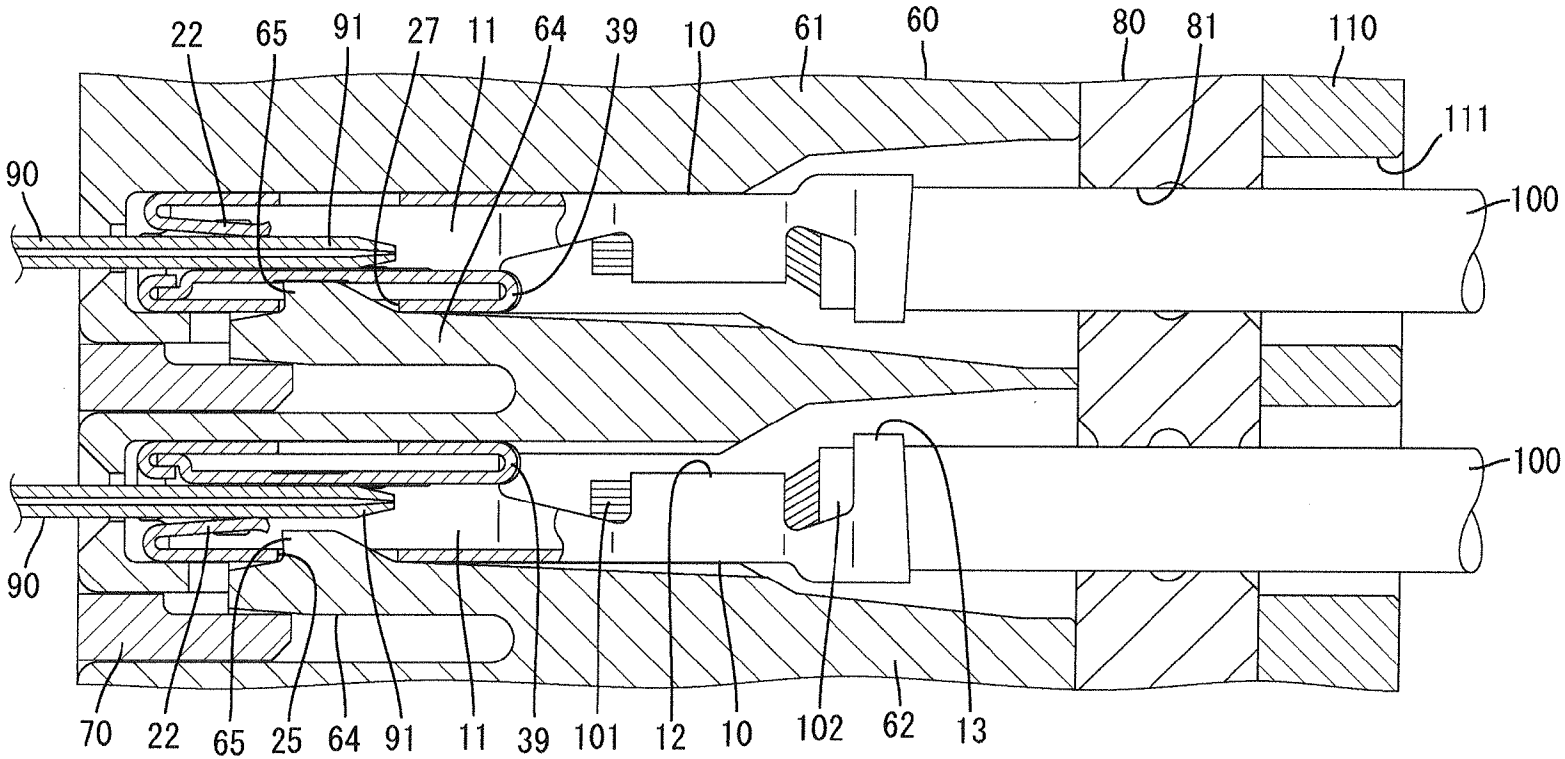
FIG. 11 is a section showing a state where the terminal fittings are connected to mating male tabs.

A terminal fitting 10 according to the invention is inserted into a housing 61 of a connector 60 as shown in FIG. 10. The connector 60 is connected to an unillustrated mating connector, and the terminal fitting 10 is electrically conductively connected to a mating terminal fitting 90 mounted in the mating connector as shown in FIG. 11.

The housing 61 is made of synthetic resin and includes a block-shaped body 62, as shown in FIG. 10, and cavities 63 extend through the body 62 in forward and backward directions. A locking lance 64 is cantilevered forward at a lower side of an inner wall of the cavity 63 and a locking projection 65 projects into the cavity 63 from a tip of the locking lance 64. The front surface of the locking projection 65 has a substantially vertical front locking surface 66 and a flat upper surface 67 that extends in substantially forward and backward directions. The locking lance 64 is resiliently deformable in vertical directions between a position where the locking projection 65 is in the cavity 63 and a position where the locking projection 65 is retracted from the cavity 63. A rearwardly open accommodation recess 68 is formed in a rear end of the body 62 and can receive a seal 80.

Figure 12:
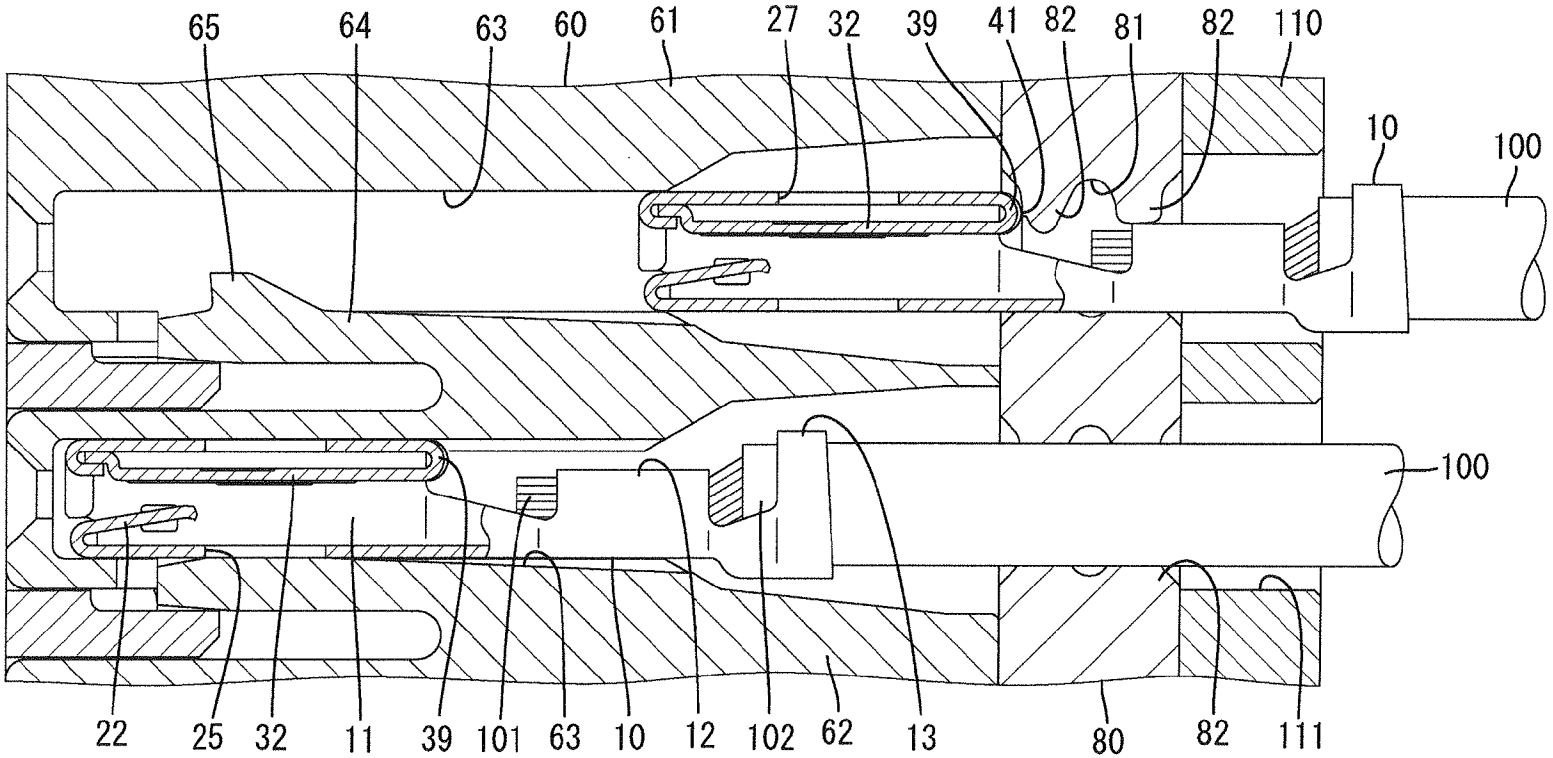
FIG. 12 is a section showing a state where an R portion is interfering with a seal member when the terminal fitting is pulled out from the cavity.

The seal 80 is made of rubber, such as silicon rubber and, as shown in FIG. 10, is in the form of a mat. Wire insertion holes 81 penetrate the seal 80 at positions corresponding to the cavities 63 and wires 100 connected to the terminal fitting 10 pass through each wire insertion hole 81. As shown in FIG. 12, lips 82 are formed one after another in forward and backward directions on the inner peripheral surface of each wire insertion hole 81 of the seal 80. The lips 82 are resiliently compressed and held in close contact with the outer peripheral surface of the wire 100 so that the outer peripheral surface of the wire 100 is sealed in a liquid-tight manner.

A holder 110 is inserted into the accommodation recess 68 of the body 62 after the seal 80 is inserted. The holder 110 is made of synthetic resin and wire insertion holes 111 penetrate the holder 110 at positions corresponding to the wire insertion holes 81 of the seal 80. The wire 100 pulled out from each wire insertion hole 81 is inserted loosely through the wire insertion hole 111. The holder 110 is locked to the body 62 via an unillustrated locking means for holding the seal 80 in the accommodation recess 68.

Figure 1:
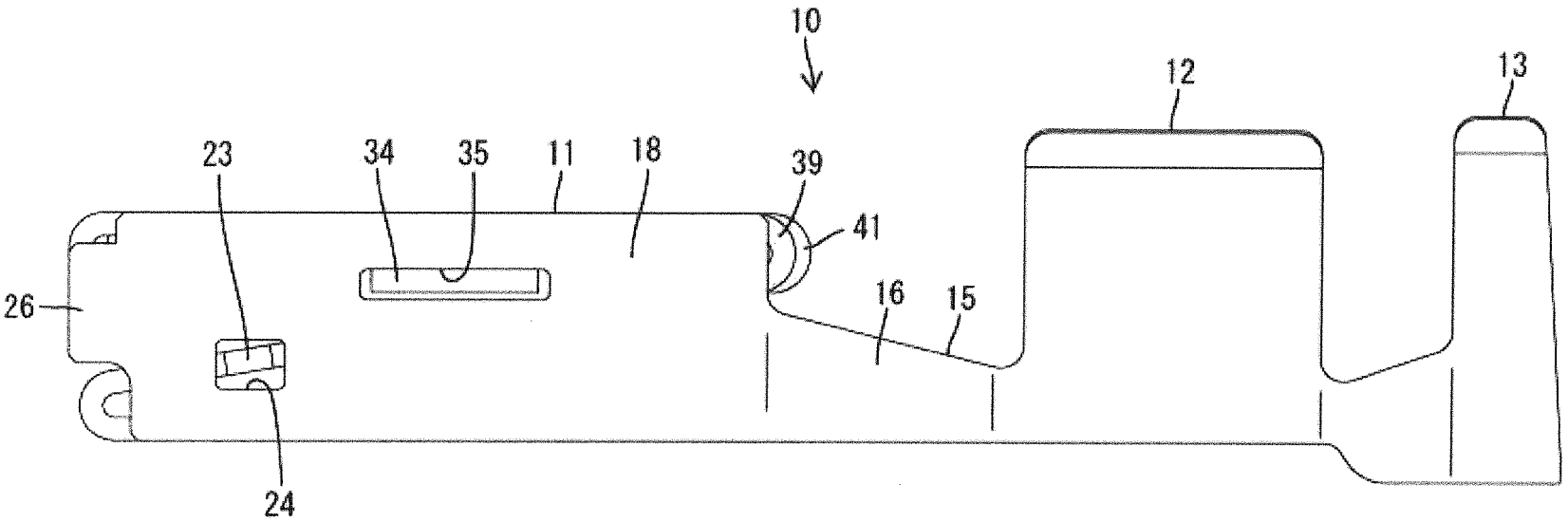
FIG. 1 is a side view of a terminal fitting according to the invention.
Figure 2:
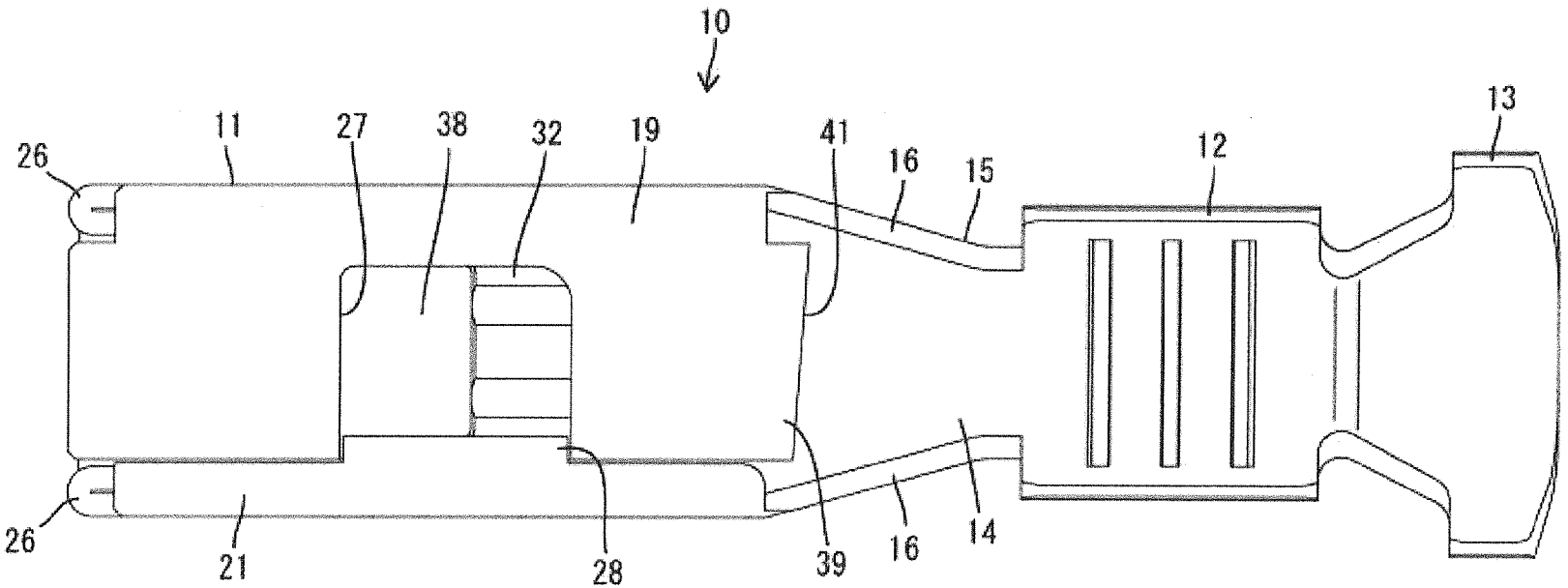
FIG. 2 is a plan view of the terminal fitting.
Figure 3:
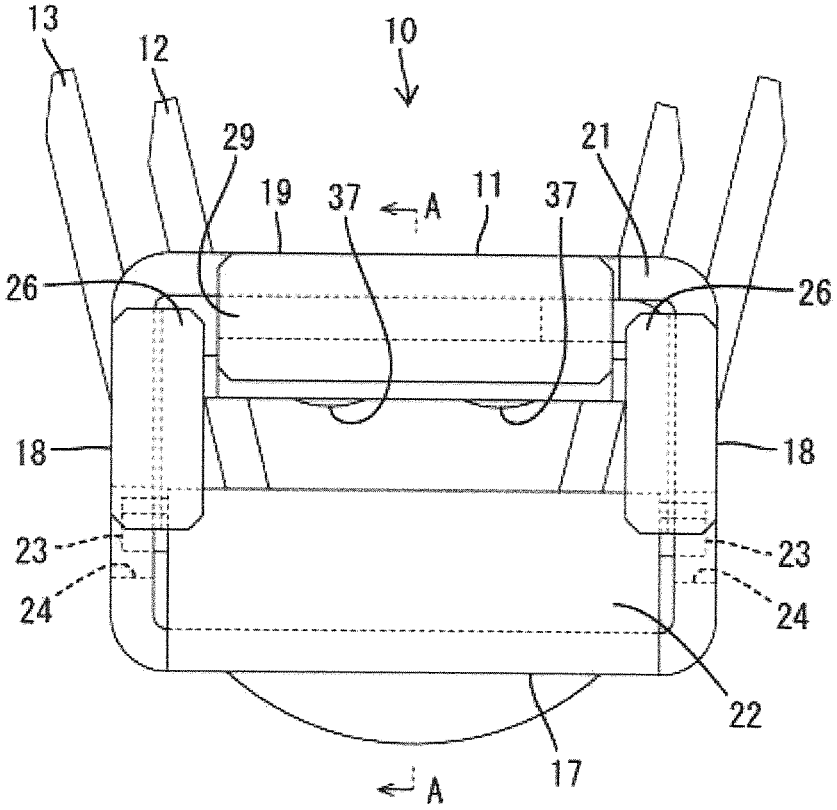
FIG. 3 is a front view of the terminal fitting.
Figure 4:
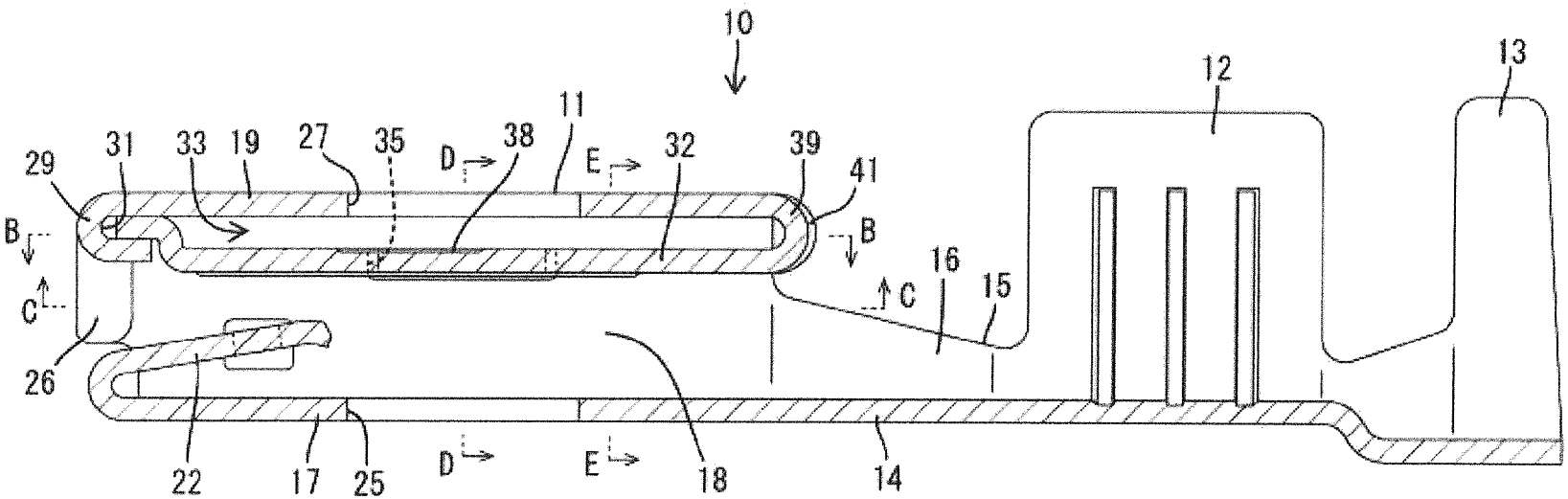
FIG. 4 is a section along A-A of FIG. 3.
Figure 9:
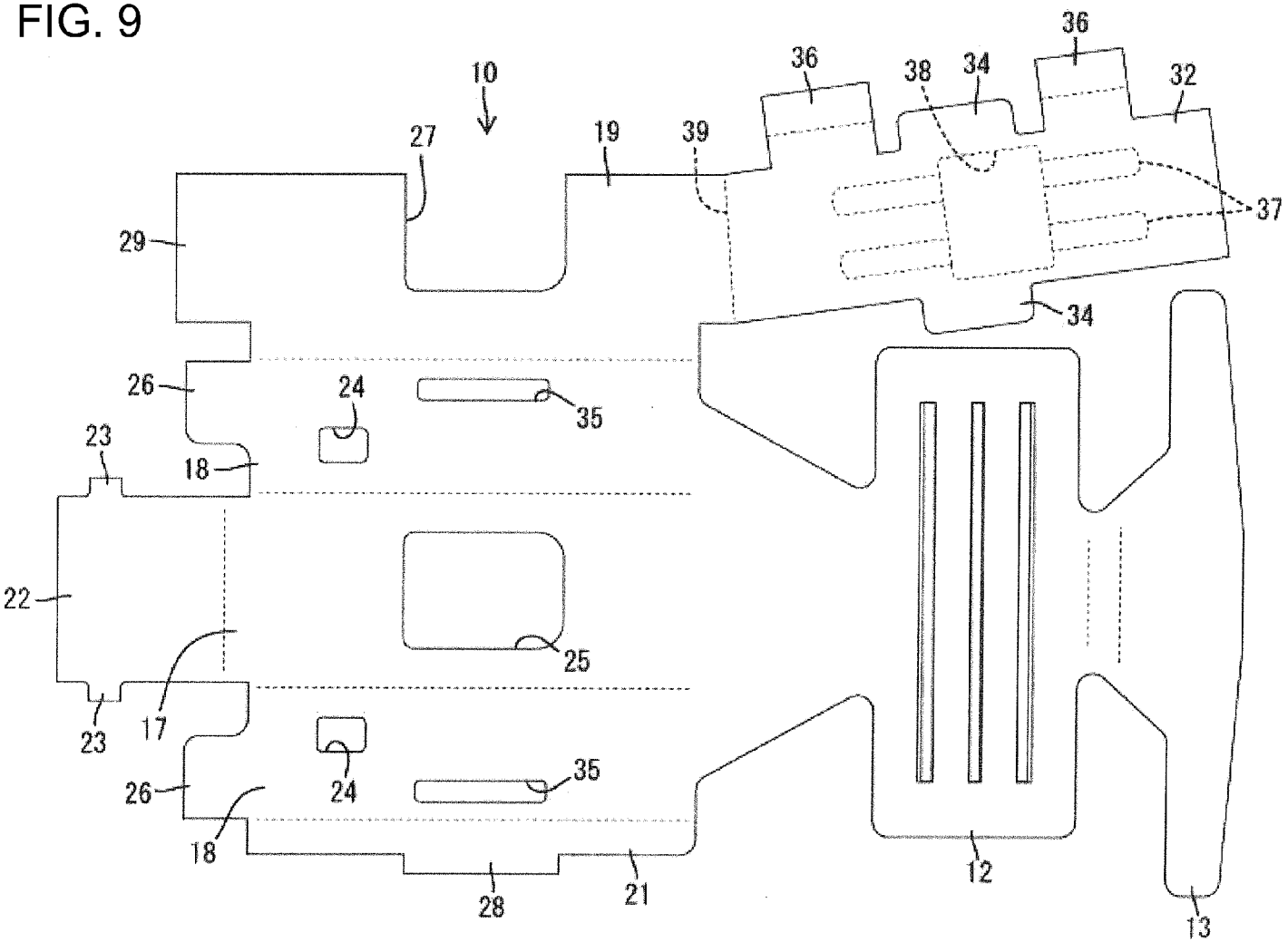
FIG. 9 is a development view of the terminal fitting.

The terminal fitting 10 is formed unitarily by bending an electrically conductive metal plate that is punched out into a development shape shown in FIG. 9. The terminal fitting 10 is a female terminal fitting and includes a rectangular tubular main portion 11 and open barrels 12, 13 in the form of open barrels connected to and behind the main portion 11, as shown in FIGS. 1 to 3. As shown in FIG. 4, a bottom plate 14 is shared by the main portion 11 and the barrels 12, 13 and extends over the entire length of the terminal fitting 10 in forward and backward directions.

As shown in FIG. 10, the barrels 12, 13 include a wire barrel 12 to be crimped and connected to a core 101 at an end of the wire 100 and an insulation barrel 13 behind the wire barrel 12 to be crimped and connected to an insulation coating 102 of the wire 100. The wire barrel 12 and the main portion 11 are connected via a connecting portion 15 that includes two side plates 16 standing at opposite widthwise sides of the bottom plate 14, as shown in FIGS. 2 and 4. The width of the bottom plate 14 is reduced gradually from the main portion 11 to the wire barrel 12, and the height of the side plates 16 is reduced gradually form the main portion 11 to the wire barrel 12.

As shown in FIGS. 3 and 4, the main portion 11 includes a base wall 17 of the bottom plate 14, two side walls 18 standing at the opposite widthwise sides of the base wall 17 and a ceiling wall 19 projects from the upper end of one side wall 18 toward the other side wall 18 and faces the base wall 17. Further, as shown in FIGS. 2 and 3, an auxiliary wall 21 projects a short distance from the upper end of the other side wall 18 toward an end edge of the ceiling wall 19. The end edges of the ceiling wall 19 and the auxiliary wall 21 butt against each other. Further, as shown in FIG. 1, the rear ends of the side walls 18 are unitary with the front ends of the side plates 16.

A resilient contact piece 22 is folded from the front end of the base wall 17 to cantilever obliquely in and back into the main portion 11, as shown in FIG. 4. The resilient contact piece 22 is resiliently deformable vertically about the front of the base wall 17. At the time of connecting the both connectors, as shown in FIG. 11, the male tab 91 of the mating terminal fitting 90 is inserted into the main portion 11 from the front and contacts the resilient contact piece 22 while resiliently deforming the resilient contact piece 22. As shown in FIGS. 1 and 3, restricting pieces 23 project the lateral edges of a leading end part of the resilient contact piece 22 and are received in restricting holes 24 in the side walls 18 of the main portion 11. The restricting pieces 23 contact the lower edges of the restricting holes 24 to limit downward deformation of the resilient contact piece 22 and contact the upper edges of the restricting holes 24 to limit upward deformation of the resilient contact piece 22.

As shown in FIG. 4, a base wall lance hole 25 penetrates through the base wall 17 slightly behind the rear end of the resilient contact piece 22. The base wall lance hole 25 is substantially rectangular in a bottom view, as shown in FIG. 9, and the locking lance 64 is insertable into the base wall lance hole 25, as shown in FIG. 11.

Figure 5:
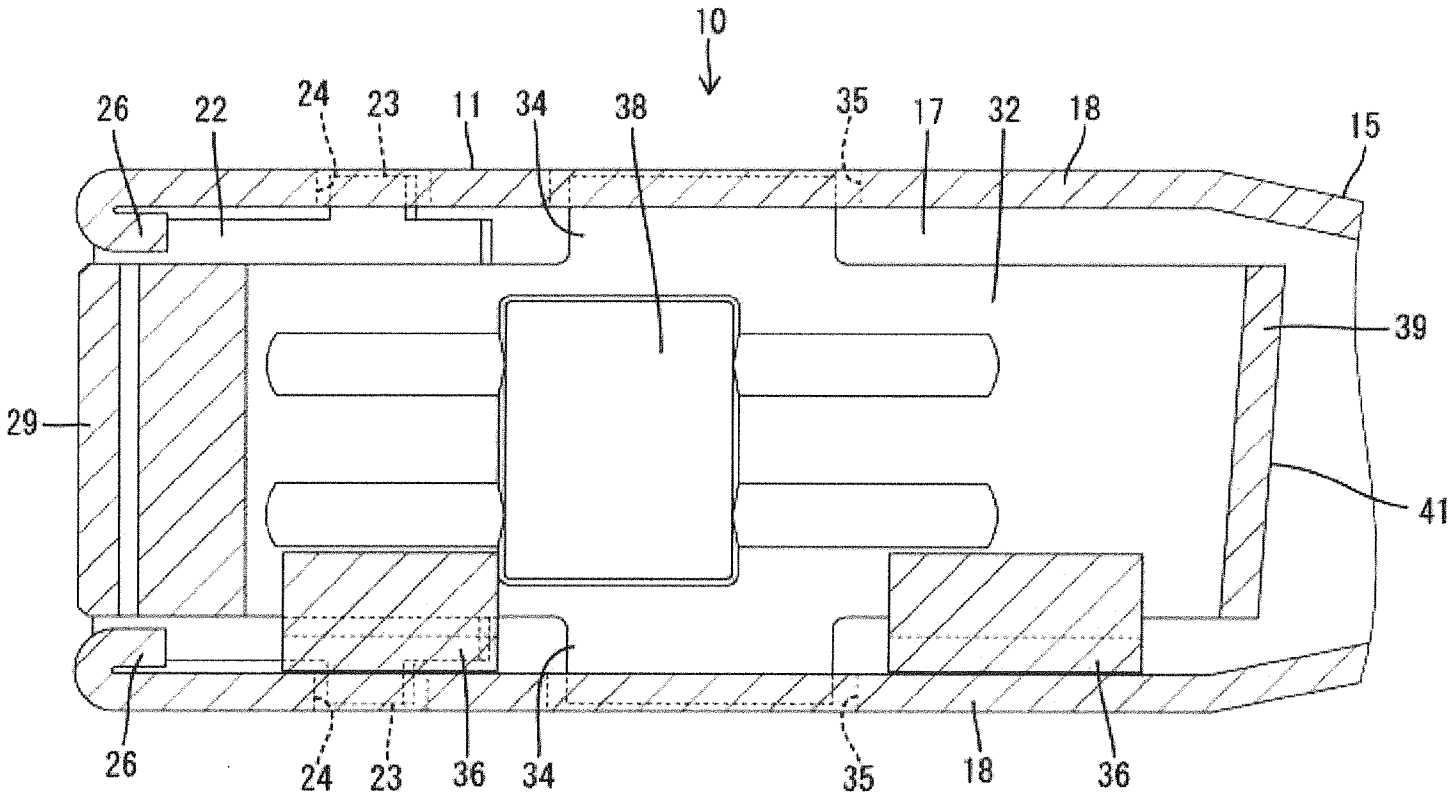
FIG. 5 is a section along B-B of FIG. 4.

Lateral protection pieces 26 are formed at the front ends of the side walls 18, as shown in FIG. 3. The lateral protection pieces 26 have U-shaped cross sections, as shown in FIG. 5, and are folded in and back after projecting forward from the front ends of the side walls 18. The front ends of the lateral protection pieces 26 are curved surfaces located more forward than the front folded end of the resilient contact piece 22. Further, thick parts of the lateral protection pieces 26 are arranged to support the ceiling wall 19 and the auxiliary wall 21 from below and to partly conceal the upper edges of sides of the resilient contact piece 22 in a front view as shown in FIG. 3.

The ceiling wall 19 is formed with a ceiling wall lance hole 27 at a position facing the base wall lance hole 25, as shown in FIG. 4. This ceiling wall side lance hole 27 has substantially the same size as the base wall lance hole 25. As shown in FIG. 2, the ceiling wall lance hole 27 is a substantially rectangular opening in a plan view with three sides defined by the ceiling wall 19 and the remaining side defined by a short piece 28 projecting from the end edge of the auxiliary wall 21.

An upper protection piece 29 is folded back and in from the front end of the ceiling wall 19 to define a substantially U-shaped cross section, as shown in FIG. 4. The front end of the upper protection piece 29 is a curved surface at substantially the same position as the lateral protection pieces 26 in forward and backward directions. A holding space 31 is formed at the inner side of the upper protection piece 29.

A fixed contact portion 32 is formed at a position in the main portion 11 facing the ceiling wall 19, as shown in FIG. 4. The contact portion 32 can engage the male tab 91 from above to sandwich the male tab 91 between itself and the resilient contact piece 22. The contact portion 32 includes the upper protection piece 29 and a contact main portion 32A that is folded in and forward from the rear end of the ceiling wall 19 to extend over substantially the entire length of the main portion 11. A clearance 33 of substantially constant vertical dimension is formed between the contact main portion 32A and the ceiling wall 19, as shown in FIG. 4. However, the front end of the contact main portion 32A is bent up to contact the ceiling wall 19, and is caulked and fixed in the holding space 31 of the contact portion 32.

Holding pieces 34 project from both lateral edges of a longitudinally central part of the contact main portion 32A, as shown in FIG. 5. On the other hand, holding holes 35 penetrate through the side walls 18 at positions corresponding to the holding pieces 34. As shown in FIG. 4, the both holding holes 35 are slits long and narrow in forward and backward directions and are at substantially the same position as the lance holes 25, 27 in forward and backward directions. The holding pieces 34 are inserted into the holding holes 35 from an inner side, as shown in FIG. 7, to hold the contact main portion 32A fixedly on the main portion 11.

Figure 6:
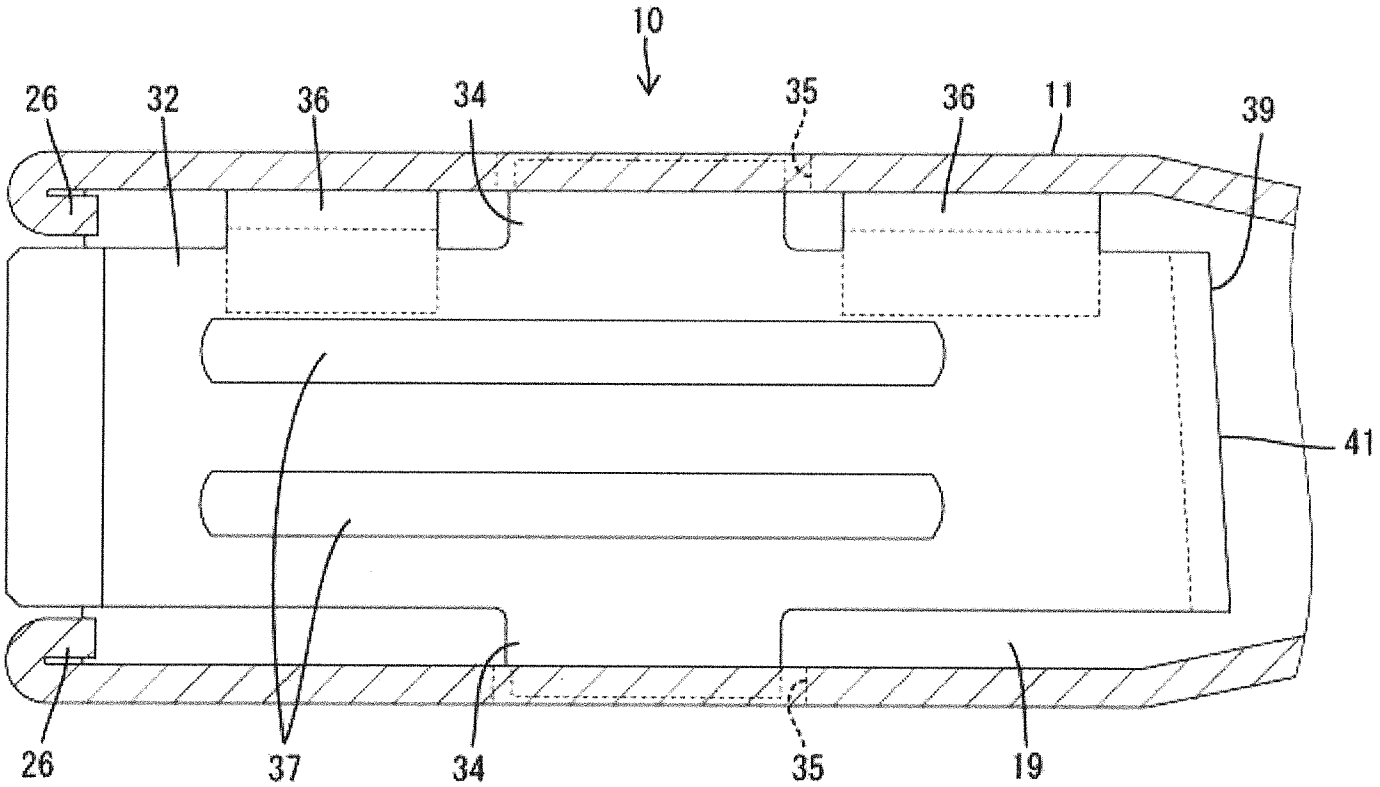
FIG. 6 is a section along C-C of FIG. 4.
Figure 8:
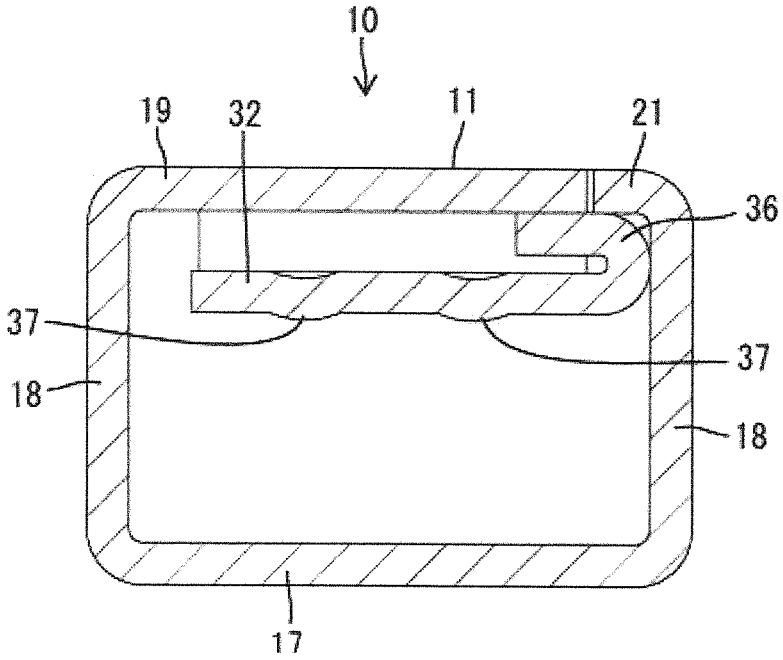
FIG. 8 is a section along E-E of FIG. 4.

As shown in FIG. 6, spacers 36 are formed at the front and rear ends of the holding piece 34 on one lateral edge of the contact main portion 32A. The spacers 36 project laterally out from the one lateral edge of the contact main portion 32A and then are folded back to have a substantially U-shaped cross section, as shown in FIG. 8. Lateral edges of the spacers 36 are curved and arranged to contact the side wall 18 from the inner side. Upper ends of the spacers 36 are arranged to contact the inner surfaces of the ceiling wall 19 and the auxiliary wall 21 from below to keep the clearance 33 between the contact main portion 32A and the ceiling wall 19.

As shown in FIG. 6, two beads 37 are formed next to each other in a width direction on the lower surface of the contact main portion 32A facing the resilient contact piece 22. The beads 37 extend in forward and backward directions and are formed by hammering the upper surface of the contact main portion 32A to project down. The upper surface of the male tab 91 contacts the beads 37 when the male tab 91 is inserted into the main portion 11. Note that a part of the lower surface of the contact main portion 32A excluding the beads 37 is a flat and even surface.

Figure 7:
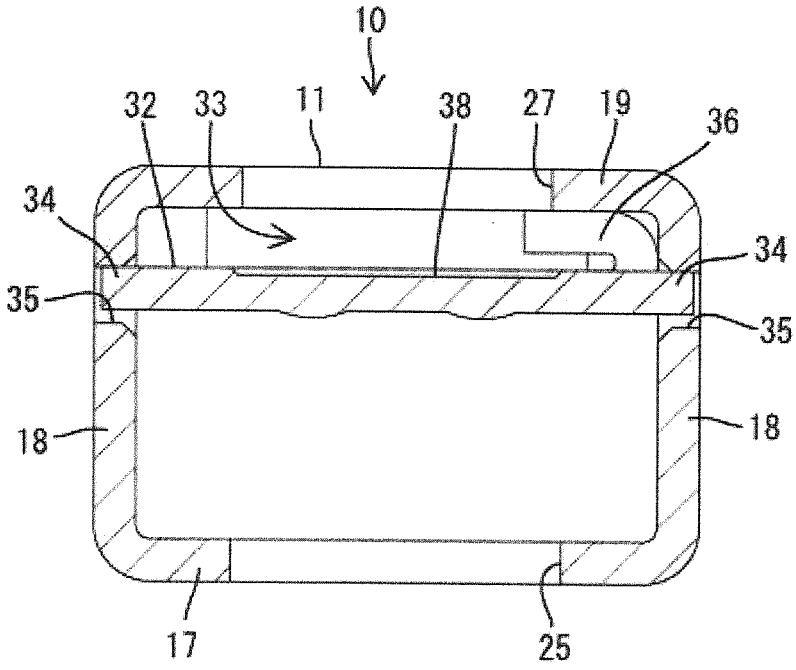
FIG. 7 is a section along D-D of FIG. 4.

As shown in FIGS. 5 and 7, a recess 38 is formed in the upper surface of the contact main portion 32A facing the ceiling wall 19 at a position corresponding to the ceiling wall lance hole 27. The recess 38 is substantially rectangular in a plan view and has a flat bottom surface extending in forward and backward directions. The recess 38 is formed within the thickness range of the contact main portion 32A by press-working the upper surface of the contact main portion 32A. Thus, no projection is formed on the lower surface of the contact main portion 32A as the recess 38 is formed (see FIG. 6). The recess 38 is visible in a front part of the ceiling wall lance hole 27 in a plan view, as shown in FIG. 2.

The folded part of the contact main portion 32A defines a curve 39 having a substantially U-shaped cross section, as shown in FIG. 4. The outer surface of the curve 39 is a curved or semicircular R surface 41 in a side view, as shown in FIG. 1, and projects back from the rear end of the main portion 11 at substantially the same height as an upper end of the insulation barrel 13. The curve 39 and the R surface 41 are arranged along an oblique direction crossing the width direction in a plan view as shown in FIG. 2 and inclined gradually back between the side walls 18.

As shown in FIG. 9, the contact main portion 32A extends in an oblique direction crossing forward and backward directions from the rear end of the ceiling wall 19 in a developed state. The barrels 12, 13 are located near the lateral edge of the contact main portion 32A. The obliquely aligned contact main portion 32A avoids interference with the barrels 12, 13. Further, the obliquely aligned contact main portion 32A enables the curved portion 39 (broken-line part in FIG. 9) at a boundary between the contact main portion 32A and the ceiling wall 19 to be oblique to the width direction.

The terminal fitting 10 is inserted into the upper cavity 63 of the housing 61 from behind with the ceiling wall 19 faced down or into the lower cavity 63 with the ceiling wall 19 faced up, as shown in FIG. 10.

Curved parts of the upper protection piece 29 and the lateral protection pieces 26 slide on the lips 82 of the wire insertion hole 81 of the seal 80 so that the terminal fitting 10 smoothly passes the wire insertion hole 81 during the inserting process. When the terminal fitting 10 is inserted to a proper depth in the upper cavity 63, the locking projection 65 of the locking lance 64 is fit through the ceiling wall lance hole 27 and into the clearance 33 between the ceiling wall 19 and the contact main portion 32A so that the tip of the locking projection 65 is in the recess 38, as shown in FIG. 10. The flat surface 67 of the locking projection 65 is arranged along the bottom surface of the recess 38 and the locking projection 65 is substantially entirely in the main portion 11. Similarly, the locking projection 65 of the locking lance 64 in the lower cavity 63 is substantially entirely in the main portion 11 and is fit resiliently into the base wall lance hole 25.

The locking surface 66 of the locking projection 65 engages the front edge of the ceiling wall lance hole 27 or the base wall lance hole 25 to hold the terminal fitting 10 in the cavity 63. A retainer 70 is mounted to the housing 61 and enters deformation spaces for the locking lances 64 (see FIG. 11) for secondarily retaining the terminal fittings 10 in the cavities 63. The outer peripheral surface of the wire 100 is held in close contact with the inner peripheral surface of the wire insertion hole 81 of the seal 80 to waterproof around the wire 100 when the terminal fitting 10 is inserted properly into the cavity 63.

The connectors then are connected to each other so that the male tabs 91 enter the main portions 11 from the front and are sandwiched between the resilient contact pieces 22 and the contact main portions 32A, as shown in FIG. 11. In this way, the both terminal fittings 10, 90 are connected electrically. Further, the male tabs 91 slide on the curved parts of the upper protection pieces 29 and the lateral protection pieces 26 to guide the male tabs 91 in the connecting process. The male tabs 91 are inserted into central parts of the main portions 11. Therefore, the insertion position of the male tab 91 is not changed even if the terminal fitting 10 is inverted.

The terminal fitting 10 may have to be pulled out of the cavity 63 for maintenance. Thus, the locking lance 64 is deformed resiliently in an unlocking direction and, in this state, the wire 100 is pulled back. Then, as shown in FIG. 12, the terminal fitting 10 moves backward and the curved portion 39 of the contact main portion 32A contacts the front lip 82 on the inner peripheral surface of the wire insertion hole 81 of the seal 80. At this time, the R surface 41 of the curved 39 slides on the inner peripheral surface of the wire insertion hole 81 so that the lips 82 smoothly and resiliently compress and the main portion 11 smoothly enters the wire insertion hole 81. Accordingly, pulling the terminal fitting 10 through the insertion hole 81 is accomplished easily. The terminal fitting 10 then is pulled out of the cavity 63 with the wire 100.

The R surface 41 of the curve 39 slides on the inner peripheral surface of the wire insertion hole 81 so that the terminal fitting 10 smoothly passes through the wire insertion hole 81 when pulling the terminal fitting 10 out from the cavity 63. As a result, operational efficiency is good and the seal 80 is not damaged. Further, the R surface 41 is on the contact main portion 32A. Thus, the entire configuration is simplified as compared with the case where the contact main portion 32A and the R surface 41 are formed separately.

The R surface 41 is oblique to the width direction in the plan view. Thus, operation resistance does not suddenly increase when the R surface 41 interferes with the seal 80. As a result, better operability is ensured.

The contact main portion 32A extends oblique to forward and backward directions with respect to the ceiling wall 19 of the main portion 11 in the developed state. Thus, the contact main portion 32A is arranged efficiently behind the main portion 11 and the contact main portion 32A can be made longer.

Further, the ceiling wall lance hole 27 into which the locking lance 64 for retaining the terminal fitting 10 in the connector 60 penetrates through the ceiling wall 19 of the main portion 11, and the clearance 33 that allows the entrance of the locking lance 64 is formed between the ceiling wall 19 and the contact main portion 32A. Thus, the locking lance 64 can escape into the clearance 33 and can be inserted deeply into the ceiling wall side lance hole 27. As a result, an appropriate engagement margin of the locking lance 64 with the main portion 11 is ensured.

The recess 38 into which the tip of the locking lance 64 escapes is formed in the surface of the contact main portion 32A facing the ceiling wall 19. Thus, the locking lance 64 can be inserted more deeply into the ceiling wall lance hole 27. As a result, the locking lance 64 is less likely to come out of the ceiling wall lance hole 27. In addition, the recess 38 is formed within the thickness range of the contact main portion 32A. Thus, the insertion space for the male tab 91 is ensured without the contact main portion 32A projecting into the insertion space for the male tab 91.

The male tab 91 is insertable substantially in the central part of the main portion 11 and the terminal fitting 10 also has the base wall lance hole 25 that penetrates through the base wall 17. Therefore, the terminal fitting 10 can be used in an inverted posture by selectively using the lance holes 25, 27. As a result, the versatility of the terminal fitting 10 is improved.

The present invention is not limited to the above described and illustrated embodiment. For example, the following embodiments are also included in the technical scope of the present invention.

A projection may be formed at a position back to back with the recess on the surface of the contact main portion facing the resilient contact piece. In this case, the recess and the projection can be formed simultaneously by hammering the contact main portion from above. The projecting end surface of the projection is preferably a flat surface so that the male tab can slide thereon. According to such a configuration, a large engagement margin of the male tab with the main portion can be ensured by increasing the depth of the recess.

An interference substance that interferes with the moving terminal fitting is not limited to a seal. For example, the interference substance may be a retainer. Further, another terminal fitting, a device, a part or the like may be an interference substance that could interfere. In view of this, a connector accommodating terminal fittings may be of a non-waterproof type.

The recess may not be formed in the contact main portion if a sufficient engagement margin of the locking lance is ensured.

The base wall lance hole may be omitted if the terminal fitting will not be used in an inverted posture.

The resilient contact piece may be cantilevered forward or both front and rear ends thereof may be supported on the base wall.

Contrary to the above embodiment, the contact portion may be arranged on the base wall side and the resilient contact piece may be on the ceiling wall side.

What is claimed is:

1. A terminal fitting, comprising:

a tubular main portion into which a mating male tab is insertable, the main portion having opposite first and second outer walls and opposite front and rear ends;

a resiliently deformable contact piece cantilevered rearward from the first outer wall at the front end of the main portion and extending into the main portion;

a contact portion in the main portion at a position facing the resilient contact piece, the contact portion having opposite front and rear ends fixed to the second outer wall in proximity to the front and rear ends of the main portion;

a lance hole penetrating through the second outer wall for allowing entry of a locking lance; and a clearance between the second outer wall and the contact portion for allowing the entry of the locking lance.

2. A terminal fitting comprising:

a tubular main portion into which a mating male tab is insertable;

a resiliently deformable contact piece in the main portion;

a contact portion in the main portion at a position facing the resilient contact piece;

an outer wall outward of the contact portion;

a lance hole penetrating through the outer wall for allowing entry of a locking lance;

a clearance between the outer wall and the contact portion for allowing the entry of the locking lance; and a recess formed in a surface of the contact portion facing the outer wall into which a tip of the locking lance escapes.

3. The terminal fitting of claim 2, wherein the recess is formed within the thickness range of the contact portion.

4. The terminal fitting of claim 2, further comprising a projection formed at a position back to back with the recess on a surface of the contact portion facing the resilient contact piece.

5. A terminal fitting, comprising:

a tubular main portion into which a mating male tab is insertable;

a resiliently deformable contact piece in the main portion;

a contact portion in the main portion at a position facing the resilient contact piece;

an outer wall outward of the contact portion;

a first lance hole penetrating through the outer wall for allowing entry of a locking lance;

a clearance between the outer wall and the contact portion for allowing the entry of the locking lance; and a second lance hole into which the locking lance for retaining the terminal fitting in the connector is insertable is also formed to penetrating through another outer wall facing the outer wall in the main portion.

6. The terminal fitting of claim 1, further comprising spacers projecting from the contact portion at positions forward and rearward of the lance hole and bent into engagement with the outer wall for maintaining the clearance.

7. The terminal fitting of claim 1, further comprising holding pieces projecting from opposite side edges of the contact portion and inserted into holding holes of the main portion to hold the contact portion fixedly on the main portion.

8. The terminal fitting of claim 7, further comprising a protection piece folded back from the second outer wall at the front end of the main portion and fixing the front end of the contact portion against the second outer wall.

9. The terminal fitting of claim 6, further comprising a protection piece folded back from the second outer wall at the front end of the main portion and fixing the front end of the contact portion against the second outer wall.

10. The terminal fitting of claim 1, further comprising a protection piece folded back from the second outer wall at the front end of the main portion and fixing the front end of the contact portion against the second outer wall.

* * * * *